US006045631A

United States Patent [19]

Tarcy et al.

[11] Patent Number: 6,045,631

[45] Date of Patent: Apr. 4, 2000

[54] METHOD FOR MAKING A LIGHT METAL-RARE EARTH METAL ALLOY

[75] Inventors: Gary P. Tarcy, Murrysville; Michael L. Slaugenhaupt, Apollo, both of Pa.

[73] Assignee: Aluminum Company of America, Pittsburgh, Pa.

[21] Appl. No.: 08/942,857

[22] Filed: Oct. 2, 1997

[51] Int. Cl.[7] ..... C22F 1/04

[52] U.S. Cl. ..... 148/551; 420/590; 419/1; 419/39; 419/42

[58] Field of Search ..... 419/1, 39, 42; 148/549, 551; 420/590

[56] References Cited

U.S. PATENT DOCUMENTS

| | | |
|---|---|---|
| 3,380,820 | 4/1968 | Hetke et al. . |
| 3,395,001 | 7/1968 | Stroup et al. . |
| 3,503,738 | 3/1970 | Cooper . |
| 3,522,021 | 7/1970 | Cook et al. . |
| 3,592,637 | 7/1971 | Brown et al. . |
| 3,619,181 | 11/1971 | Willey . |
| 3,729,397 | 4/1973 | Goldsmith et al. . |
| 3,846,121 | 11/1974 | Schmidt et al. . |
| 3,855,087 | 12/1974 | Yamanaka et al. . |
| 3,935,004 | 1/1976 | Faunce . |
| 3,941,588 | 3/1976 | Dremann . |
| 4,108,645 | 8/1978 | Mitchell et al. . |
| 4,171,215 | 10/1979 | Dremann . |
| 4,648,901 | 3/1987 | Murray et al. . |
| 4,689,090 | 8/1987 | Sawtell et al. . |
| 5,037,608 | 8/1991 | Tarcy et al. . |
| 5,059,390 | 10/1991 | Burleigh et al. . |
| 5,238,646 | 8/1993 | Tarcy et al. . |

FOREIGN PATENT DOCUMENTS

| | | |
|---|---|---|
| 2555611 | 5/1985 | France . |
| 2 350 406 | 4/1974 | Germany . |
| 873692 | 11/1983 | U.S.S.R. . |

*Primary Examiner*—Sikyin Ip

*Attorney, Agent, or Firm*—Gary P. Topolosky; Arnold B. Silverman

[57] ABSTRACT

A method of making a light metal-rare earth metal alloy includes mixing a light metal powder, such as aluminum powder, with a finely divided rare earth metal-containing compound, such as scandium oxide, creating a billet by subjecting the mixture to cold isostatic compaction. The billet formed from the mixture of aluminum powder and rare earth metal-containing compound is preferably sintered at a temperature of about 600° C. to 800° C. and preferably about 640° C. to 680° C., and subsequently feeding the billet to a molten aluminum bath. This method facilitates conversion of in excess of 95% of the rare earth metal oxide to the aluminum-rare earth metal alloy. The rare earth metal may be scandium.

28 Claims, No Drawings

METHOD FOR MAKING A LIGHT METAL-RARE EARTH METAL ALLOY

BACKGROUND OF THE INVENTION

1. Field of the Invention

The invention relates to a method of making a light metal-rare earth metal alloy wherein a very high percentage of the rare earth metal-containing compound is converted into the light metal-rare earth metal alloy by a method employing cold isostatic compaction.

2. Description of the Prior Art It has been known that light metal-scandium alloys, such as aluminum based scandium alloys and aluminum based scandium-magnesium alloys, may be used advantageously due to their high strength to weight ratios and corrosion resistance. Among the uses have been use in the nuclear and aerospace industries.

One of the problems that has been encountered is the difficulty in economically effecting incorporation of scandium into such aluminum base alloys. Further, it has been difficult and expensive to attempt to produce "ingot quality" scandium for such uses.

U.S. Pat. Nos. 5,037,608 and 5,238,646, owned by the assignee of the present application, disclose a method of making a light metal-rare earth metal alloy which includes adding a pellet made from a mixture of scandium oxide and aluminum powders to a molten bath. These pellets are disclosed as having been made at pressures in excess of 9 ksi. The disclosures of these two patents are expressly incorporated herein by reference.

Despite these prior art technologies, there remains a need for a method of making a light metal-rare earth alloy wherein a higher percentage of rare earth-containing compound is converted to and employed in the light metal-rare earth alloy.

SUMMARY OF THE INVENTION

The above-described need has been met by the method of the present invention wherein in one aspect aluminum powder is mixed with a finely divided rare earth-containing powder, which may be scandium oxide powder. A billet is formed from the mixture of powders by cold isostatic compaction. Subsequently the billet is sintered at a temperature of about 600° C. to 800° C. and the resultant billet is fed to a molten aluminum bath. The billet is preferably at an isostatic pressure and sintering pressure of about 7 kps to 30 kps. This sintering of the billet is effected in about 5 minutes to 2 hours, and preferably about 5 to 10 minutes. This results in effecting a greater than 95% conversion of the rare earth metal oxide to the aluminum-rare earth metal alloy.

It is an object of the present invention to provide an efficient and economical means for creating a light metal-rare earth metal alloy wherein a high percentage of rare earth metal oxide is converted into the light metal-rare earth metal alloy.

It is a further object of the present invention to provide a method wherein the rare earth metal is scandium and in excess of about 95% of the scandium oxide is converted to the aluminum-scandium alloy.

It is a further object of the present invention to effect such alloy creation by creating a billet from a mixture of an aluminum powder and a scandium oxide powder, each generally of the same size.

It is a further object of the present invention to provide such a method to create aluminum-scandium alloys employing conventional aluminum processing technology and providing the scandium from a billet created in the manner disclosed herein.

These and other objects of the invention will be more fully understood from the following description of the invention.

DESCRIPTION OF THE PREFERRED EMBODIMENTS

As employed herein, the term "light metal" shall mean any metallic element or alloy thereof having a relatively low density which may, for example, be below about 4 g/cc. This term shall expressly include aluminum as well as magnesium and zinc.

In a preferred practice of the present invention a finely divided light metal powder such as an aluminum powder is intimately admixed with a rare earth metal containing compound which rare earth metal may be scandium oxide. It is preferred that the aluminum powder and rare earth metal-containing compound each be generally of the same size which preferably is on the order of about 10 microns. It is also preferred that each of the powder components have at least 90% of the particles less than 30 microns.

In a broader aspect of the invention, after the powders are admixed they are subjected to cold isostatic compaction to form a billet. Subsequent to billet formation the billet is sintered under elevated pressure at a temperature of about 600° C. to 800° C. and preferably about 640° C. to 680° C. The cold isostatic compaction may be effected generally at ambient temperature. It will generally be preferable to effect such compaction at about 10° C. to 50° C. The elevated temperature billet sintering is effected for a period of about 5 minutes to 2 hours and preferably for about 5 to 10 minutes. The isostatic compaction and billet sintering are preferably effected at pressures of about 7 kps to 30 kps.

The final billet is introduced into a bath of molten aluminum to thereby create the desired alloy. The billet formation process preferably takes place in an inert atmosphere which may, for example, be an argon atmosphere. If desired, normal atmosphere may be employed in lieu of an inert atmosphere.

It has been determined that by employing this method in excess of about 95% of the rare earth metal oxide, such as scandium oxide, and preferably about 100% of the rare earth metal oxide, is reduced and dispersed within the molten metal bath.

EXAMPLES

A series of experiments were performed in order to verify operability of the methods of the present invention. The results of these tests are shown in Table 1.

Mixing of the aluminum particles with the scandium oxide particles was effected by tumble mixing in a V-blender. The mixture was subjected to cold isostatic compaction at about 25° C. at a pressure of about 30 ksi. The sintering operation to create the billet employed a pressure of about 30 ksi for about 5 to 10 minutes. This produced billets of a diameter of about 8 inches and a length of about 4 feet.

TABLE 1

| A Billet # | B Billet Wt. lbs. | C Billet Wt. kg. | D Wt. $Sc_2O_3$ | E % Sc in $Sc_2O_3$ | F Corr. Wt. $Sc_2O_3$ | G Corr. Wt. Sc | H Ther % Sc | I Anal % Sc | J % Conv. | K Sinter Temp. |
|---|---|---|---|---|---|---|---|---|---|---|
| 1 (Scale-Up) | 77.0 | 35.0 | 0.655 | 0.616 | 0.62 | 0.403 | 0.52 | 0.51 | 97.3 | 750 |
| 1 (Top) | 133.2 | 58.0 | 9.17 | 0.616 | 8.69 | 5.649 | 4.24 | 5.05 | 119.1 | 660 |
| 1 (Middle) | 133.2 | | 9.17 | 0.616 | 8.69 | 5.649 | 4.24 | 4.50 | 106.1 | 660 |
| 1 (Bottom) | 133.2 | | 9.17 | 0.616 | 8.69 | 5.649 | 4.24 | 4.09 | 96.4 | 660 |
| 2 (Top) | 142.0 | 64.4 | 10.00 | 0.636 | 9.78 | 6.360 | 4.39 | 4.71 | 107.4 | 675 |
| 2 (Middle) | 142.0 | | 10.00 | 0.636 | 9.78 | 6.360 | 4.39 | 3.91 | 89.1 | 675 |
| 2 (Bottom) | 142.0 | | 10.00 | 0.636 | 9.78 | 6.360 | 4.39 | 4.11 | 93.7 | 675 |
| 3 | 143.5 | 65.2 | 10.00 | 0.636 | 9.78 | 6.360 | 4.39 | 4.90 | 111.7 | 675 |
| 4 | 111.0 | 50.4 | 10.00 | 0.636 | 9.78 | 6.360 | 4.39 | 4.86 | 110.8 | 675 |
| 5 | 144.0 | 65.4 | 10.00 | 0.636 | 9.78 | 6.360 | 4.39 | 5.00 | 114.0 | 665 |
| 6 | 139.0 | 63.0 | 10.00 | 0.636 | 9.78 | 6.360 | 4.39 | 3.79 | 86.4 | 665 |
| 7 | 138.0 | 62.8 | 10.00 | 0.636 | 9.78 | 6.360 | 4.39 | 3.96 | 90.3 | 665 |
| 8 | 144.0 | 65.4 | 10.00 | 0.636 | 9.78 | 6.360 | 4.39 | 3.71 | 84.6 | 660 |
| 9 | 142.5 | 64.6 | 10.00 | 0.636 | 9.78 | 6.360 | 4.39 | 5.02 | 114.4 | 660 |
| 10 | 144.0 | 65.4 | 10.00 | 0.636 | 9.78 | 6.360 | 4.39 | 4.02 | 91.7 | 660 |
| 11 | 141.0 | 64.0 | 10.00 | 0.636 | 9.78 | 6.360 | 4.39 | 4.96 | 113.1 | 665 |
| 12 | 144.0 | 65.4 | 11.00 | 0.650 | 11.00 | 7.150 | 4.93 | 5.06 | 102.6 | 715 |
| 13 | 144.5 | 65.6 | 11.00 | 0.650 | 11.00 | 7.150 | 4.93 | 5.36 | 108.7 | 715 |
| 14 | 144.5 | 65.6 | 11.00 | 0.650 | 11.00 | 7.150 | 4.93 | 4.19 | 85.0 | 715 |
| 15 | 144.5 | 65.6 | 11.00 | 0.650 | 11.00 | 7.150 | 4.93 | 5.09 | 103.2 | 665 |
| 16 | 144.5 | 65.6 | 11.00 | 0.650 | 11.00 | 7.150 | 4.93 | 4.64 | 94.1 | 665 |
| 17 | 144.0 | 65.4 | 11.00 | 0.650 | 11.00 | 7.150 | 4.93 | 4.71 | 95.5 | 665 |
| 18 | 144.5 | 65.6 | 11.00 | 0.650 | 11.00 | 7.150 | 4.93 | 4.37 | 88.6 | 665 |
| 19 | 144.5 | 65.6 | 11.00 | 0.650 | 11.00 | 7.150 | 4.93 | 4.32 | 87.6 | 665 |
| 20 | 142.0 | 64.4 | 11.00 | 0.650 | 11.00 | 7.150 | 4.93 | 4.08 | 82.7 | 665 |
| 21 | 143.5 | 65.2 | 11.00 | 0.650 | 11.00 | 7.150 | 4.93 | 4.56 | 92.5 | 640 |
| Total Wt. | 3039.70 | 1342.6 | 219.83 | | 217.16 | 141.15 | Average | 4.52 | 98.78 | |

Column A identifies the twenty-one billets with the first and second billets having multiple entries. Column B lists the billet weight in pounds, and Column C lists the billet weight in kilograms. The weight of the scandium oxide contained within the billet is set forth in pounds in Column D. The percentage of scandium present in the scandium oxide is shown in Column E. The corrected weights of $Sc_2O_3$ and Sc as shown in Columns F and G were determined by multiplying the respective weights by purity, which in this case was 0.65. The theoretical percent of scandium in the billet is shown in Column H, and the analytical percentage of scandium as determined by atomic absorption is shown in Column I. Column J states the percentage of scandium oxide reduced and converted in the billet from its oxide form through a stable Al-Sc intermetallic and into the melt. (The percentages in excess of 100% were the result of segregation and concentration within the billet.) It is noted that the average percentage conversion was 98.78% which is substantially above the desired improved 95% and is approaching 100%. Column K lists the sintering temperatures.

The preferred range of temperatures is about 600° C. to 800° C. with the most preferred being about 640° C. to 680° C.

While reference has been made herein to production of an aluminum-rare earth metal binary alloy such as aluminum-scandium, other alloying constituents may be added if desired and tolerable levels of certain impurities may be present.

It will be appreciated from the foregoing that the methods of the present invention provide an efficient means of converting a very high percentage, on the order of about 95 to 100%, of a rare earth metal oxide such as scandium oxide into the rare earth metal such as scandium in the billet for use in a molten bath of aluminum in producing an aluminum-rare earth metal alloy. This provides an efficient and economical means for creation of aluminum-rare earth metal alloys.

Whereas particular embodiments of the present invention have been described herein for purposes of illustration, it will be evident to those skilled in the art that numerous variations in the details may be made without departing from the invention as defined in the appended claims.

We claim:

1. A method of making a light metal-rare earth metal alloy comprises:

combining a light metal powder with a finely divided, rare earth metal-containing compound to form a mixture;

subjecting said mixture to cold isostatic compaction to form a billet; and feeding said billet to a molten aluminum bath.

2. The method of claim 1 which further includes subsequent to forming said billet and prior to feeding said billet to said molten aluminum bath sintering said billet at about 600° to 800° C.

3. The method of claim 2 which further includes employing aluminum as said light metal and scandium oxide as said rare earth metal-containing compound.

4. The method of claim 3 wherein said aluminum powder and scandium oxide powder are substantially the same average particle size.

5. The method of claim 2 wherein said cold isostatic compaction is performed at a pressure of about 7 kps to 30 kps.

6. The method of claim 2 wherein said billet is sintered for about 5 minutes to 2 hours.

7. The method of claim 3 which results in greater than about 95% conversion of said scandium oxide to scandium in said aluminum-scandium alloy.

8. The method of claim 3 wherein said cold isostatic compaction is performed at an ambient temperature.

9. The method of claim 2 wherein said cold isostatic compaction is performed at about 10° to 50° C.

10. The method of claim 7 wherein said billet is sintered at one or more temperatures between about 640° to 680° C.

11. The method of claim 3 where nearly 100% of said rare earth metal-containing compound is converted in said aluminum-rare earth metal alloy.

12. The method of claim 7 wherein said billet is sintered in an inert environment.

13. The method of claim 12 wherein said inert environment consists essentially of argon.

14. The method of claim 4 wherein said aluminum powder and said scandium oxide powder each have an average particle size of about 10 microns.

15. A method for making a light metal-rare earth metal alloy comprises:

combining a light metal powder with a finely divided, rare earth metal-containing compound to form a mixture;

forming a billet from said mixture;

sintering said billet at one or more temperatures between about 600° to 800° C.; and feeding said billet to a molten aluminum bath.

16. The method of claim 15 wherein said billet is formed by cold isostatic compaction.

17. The method of claim 15 wherein aluminum is employed as said light metal powder and scandium oxide as said rare earth metal-containing compound.

18. The method of claim 17 wherein said aluminum powder and scandium oxide are substantially the same average particle size.

19. The method of claim 16 wherein said cold isostatic compaction is performed at a pressure of about 7 kps to 30 kps.

20. The method of claim 16 wherein said billet is sintered for about 5 minutes to 2 hours.

21. The method of claim 17 which results in greater than about 95% conversion of said scandium oxide to scandium in said aluminum-scandium alloy.

22. The method of claim 16 wherein said cold isostatic compaction is performed at an ambient temperature.

23. The method of claim 16 wherein said cold isostatic compaction is performed at about 10° to 50° C.

24. The method of claim 20 wherein said billet is sintered at one or more temperatures between about 640° to 680° C.

25. The method of claim 16 wherein nearly 100% of said rare earth metal-containing compound is converted in said aluminum-rare earth metal alloy.

26. The method of claim 16 wherein said billet is sintered in an inert environment.

27. The method of claim 26 wherein said inert environment consists essentially of argon.

28. The method of claim 18 wherein said aluminum powder and said scandium oxide powder each have an average particle size of about 10 microns.

* * * * *